US011350765B2

(12) United States Patent
Yang

(10) Patent No.: US 11,350,765 B2
(45) Date of Patent: Jun. 7, 2022

(54) MULTI-FUNCTIONAL BABY BED

(71) Applicant: ZHONGTONG (XIAMEN) CHILDREN PRODUCTS CO., LTD., Xiamen (CN)

(72) Inventor: Jianbo Yang, Xiamen (CN)

(73) Assignee: ZHONGTONG (XIAMEN) CHILDREN PRODUCTS CO., LTD., Xiamen (CN)

( * ) Notice: Subject to any disclaimer, the term of this patent is extended or adjusted under 35 U.S.C. 154(b) by 0 days.

(21) Appl. No.: 16/997,947

(22) Filed: Aug. 20, 2020

(65) Prior Publication Data

US 2021/0212478 A1 Jul. 15, 2021

(30) Foreign Application Priority Data

Jan. 15, 2020 (CN) ..... 202020085520.8

(51) Int. Cl.
*A47D 9/00* (2006.01)
*A47D 11/00* (2006.01)
*A47D 9/02* (2006.01)

(52) U.S. Cl.
CPC ..... *A47D 11/005* (2013.01); *A47D 9/02* (2013.01)

(58) Field of Classification Search
CPC ..... A47D 11/005; A47D 11/00; A47D 9/02; A47D 9/00; A47D 9/04
See application file for complete search history.

(56) References Cited

U.S. PATENT DOCUMENTS

2015/0173523 A1* 6/2015 Horst ..... A47D 9/04 5/11
2015/0342365 A1* 12/2015 Corso ..... A47D 9/00 5/102
2015/0342367 A1* 12/2015 Corso ..... A47D 9/005 5/102
2019/0328151 A1* 10/2019 Sclare ..... A47D 9/00

* cited by examiner

*Primary Examiner* — Fredrick C Conley
(74) *Attorney, Agent, or Firm* — Bayramoglu Law Offices LLC

(57) ABSTRACT

A multi-functional baby bed includes a left support frame, a right support frame, a swing frame and a cradle frame. The swing frame and the cradle frame are provided between the left support frame and the right support frame. The swing frame is pivotably connected to the left support frame and the right support frame. The swing frame and the cradle frame are detachably connected. The left and right support frames are structurally the same and oppositely disposed. The top of each of the left and right support frame has a rotating device configured to control the movement of the swing frame. The rotating device can be rotated 90°. When the swing frame is fixed, the cradle frame is fixed accordingly and the device may function as a bed. When the swing frame swings, the cradle frame swings accordingly, thus functioning as a cradle.

9 Claims, 17 Drawing Sheets

MULTI-FUNCTIONAL BABY BED

CROSS REFERENCE TO THE RELATED APPLICATIONS

This application is based upon and claims priority to Chinese Patent Application No. 202020085520.8, filed on Jan. 15, 2020, the entire contents of which are incorporated herein by reference.

TECHNICAL FIELD

The present invention relates to the field of children products, and more specifically, to a multi-functional baby bed.

BACKGROUND

A baby bed is a small bed that provides a sleeping environment for infants. Currently, there are different styles of baby beds for infants available in the prior art, and these baby beds come in a variety of prices and functions. Current baby beds include fixed-side-style baby beds and cradles. Beds and cradles have their independent functions but cannot be combined for mutual use. Moreover, the current baby beds have a short service life and cannot accommodate the changing needs and sizes of the growing child, and cannot provide other functions as well. In view of the above-mentioned issues, it is highly desirable to develop a multi-functional baby bed.

SUMMARY

The present invention provides a multi-functional baby bed to overcome the limited function of existing baby beds.

In order to solve the technical problems mentioned above, the present invention adopts the following technical solutions:

A multi-functional baby bed includes a left support frame, a right support frame, a swing frame and a cradle frame. The swing frame and the cradle frame are provided between the left support frame and the right support frame. The swing frame is pivotably connected to the left support frame and the right support frame. The cradle frame and the swing frame are detachably connected. The left support frame and the right support frame have the same structure and are arranged opposite to each other. The top of each of the left support frame and the right support frame is provided with a rotating device configured to control movement of the swing frame. The rotating device can be rotated 90°.

Each of the left support frame and the right support frame includes a support base, a support rod, a sleeve rod and a curved rod. The bottom of the support rod is connected to the top of the support base. The support rod is sleeved inside the sleeve rod, and the sleeve rod can be lifted and lowered relative to the support rod. The bottom of the curved rod is connected to the top of the sleeve rod. The swing frame includes a left connecting part, a left connecting rod, a right connecting part, a right connecting rod and a seating frame. The top of the left connecting rod is connected to the bottom of the left connecting part, and the top of the right connecting rod is connected to the bottom of the right connecting part. The seating frame is connected between the bottom of the left connecting rod and the bottom of the right connecting rod. The top of the left connecting part is located on the inside of the top of the curved rod of the left support frame, and the top of the right connecting part is located on the inside of the top of the curved rod of the right support frame.

A fixed shaft passes through the inside of the top of the curved rod. One end of the fixed shaft passes through the curved rod and is correspondingly connected to the left connecting part or the right connecting part. The other end of the fixed shaft extends outside the curved rod. A moving cavity is provided in the upper part of the curved rod. A moving member is arranged inside the moving cavity. The moving member includes a baffle, an upper plug part, a lower plug part and a receiving chamber. The upper plug part, the receiving chamber and the lower plug part are successively arranged from top to bottom on the inner side surface of the baffle and pass through the moving cavity. The outer end of the receiving chamber is an open structure. The upper plug chamber and the lower plug chamber are arranged inside each of the left connecting part and the right connecting part. The upper plug part and the lower plug part are inserted into the corresponding upper plug chamber and lower plug chamber, respectively. The rotating device includes a rotating cylinder and a rotating part. The rotating cylinder and the rotating part are sleeved outside the fixed shaft. One end of the rotating cylinder passes through the curved rod and is located in the receiving chamber. The other end of the rotating cylinder is connected to the rotating part. The rotating part is located on the outer end surface of the curved rod. A clamping groove is provided on the top surface of one end of the rotating cylinder, and a spiral groove connected to the clamping groove is provided on the outer periphery of the rotating cylinder. The inner top surface of the receiving chamber is provided with a clamping column that mates with the clamping groove and the spiral groove. The clamping column is located in the clamping groove when the rotating part is in the horizontal direction. A spring is arranged between the clamping column and the inner side surface of the rotating part, and the spring is sleeved outside the rotating cylinder.

The inner side surface of each of the left connecting part and the right connecting part is provided with a first inserting part. Two insertion parts are arranged on the left side and right side of the cradle frame, respectively. The two insertion parts correspond to the first inserting part of the left connecting part and the first inserting part of the right connecting part, respectively, and are each provided with a first slot. The first inserting part is inserted into the corresponding first slot. The inner side surface of the first inserting part is provided with an elastic clamping part, and the inner side surface of the insertion part is provided with a clamping groove in which the elastic clamping part is clamped.

One side surface of the bottom of the curved rod is provided with an arc-shaped groove. The arc-shaped groove is provided with a pressing part. A housing is fixedly arranged at the bottom of the sleeve rod. A lifting block and a clamping block are arranged inside the housing. The lifting block is configured to drive the clamping block to rotate. One end of the clamping block is a clamping portion. The inner side surface of the support rod is provided with a plurality of notches spaced apart longitudinally, wherein the clamping portion is clamped in the plurality of notches. A pull rope is provided between the lifting block and the pressing part. A first spring is provided between the top surface of the lifting block and the inner top surface of the housing. The first spring is sleeved on the pull rope.

The lifting block includes a connecting part and two connecting plates arranged at the bottom of the connecting part. The two connecting plates are spaced apart and each provided with an inclined through slot. The clamping block has three ends. A first end of the three ends of the clamping block is the clamping portion. A second end of the three ends of the clamping block is hinged to the inner side surface of the housing. A third end of the three ends of the clamping block is hinged to the through slot of the two connecting plates.

The cradle frame includes a lifting tube, a left tube, a rear tube, a right tube, a left guide rail, a right guide rail, a left vertical tube, a right vertical tube and a support frame. The left guide rail, the right guide rail, the left vertical tube, and the right vertical tube are arranged at four corners of the support frame. Each of the inner side surface of the left guide rail and the inner side surface of the right guide rail is provided with a lifting member. The lifting tube is provided between the lifting member on the left guide rail and the lifting member on the right guide rail. The left tube is connected between the top of the left guide rail and the top of the left vertical tube. The rear tube is connected between the top of the left vertical tube and the top of the right vertical tube. The right tube is connected between the top of the right vertical tube and the top of the right guide rail. The four corners of the support frame are connected to the bottom of the left guide rail, the bottom of the right guide rail, the bottom of the left vertical tube and the bottom of the right vertical tube, respectively. The middle of the left tube and the middle of the right tube are respectively connected to the tops of the two insertion parts.

The lifting member is a hollow structure. A moving block is provided inside the lifting member. Each of the upper part of the inner side surface of the left guide rail and the upper part of the inner side surface of the right guide rail is provided with a second slot. One end of the moving block is provided with a second inserting part. The second inserting part extends out of the lifting member and is inserted into the corresponding second slot. The other end of the moving block is provided with a spring receiving groove. A second spring is arranged between the spring receiving groove and the inner side surface of the lifting member. The moving member is provided with a strip-shaped limit groove. The inner side wall of the lifting member is provided with a limit rod extending into the strip-shaped limit groove. The bottom surface of the moving member is provided with a flipping portion. The bottom surface of the lifting member is provided with a moving slot. The flipping portion extends outside the moving slot.

A telescopic inner tube is provided inside one end of the support base. A first reinforcing rod is provided between the support base of the left support frame and the support base of the right support frame. A second reinforcing rod is provided between the sleeve rod of the left support frame and the sleeve rod of the right support frame.

According to the above description of the present invention, the present invention has the following advantages over the prior art. The present invention has a novel structure and ingenious design. The rotating device can control the swing frame to swing or not. When the swing frame is fixed, the cradle frame is fixed accordingly. The present invention can function as a baby bed. When the swing frame swings, the cradle frame swings accordingly. The present invention can also be used as a cradle. The cradle frame and the swing frame are detachably connected. In this way, when the cradle frame is detached, infants can sit on the swing frame to swing. The present invention can function as a baby bed, a cradle and a swing, and thus is highly versatile to meet the needs of infants at different ages.

DETAILED DESCRIPTION OF THE EMBODIMENTS

Figure 1:
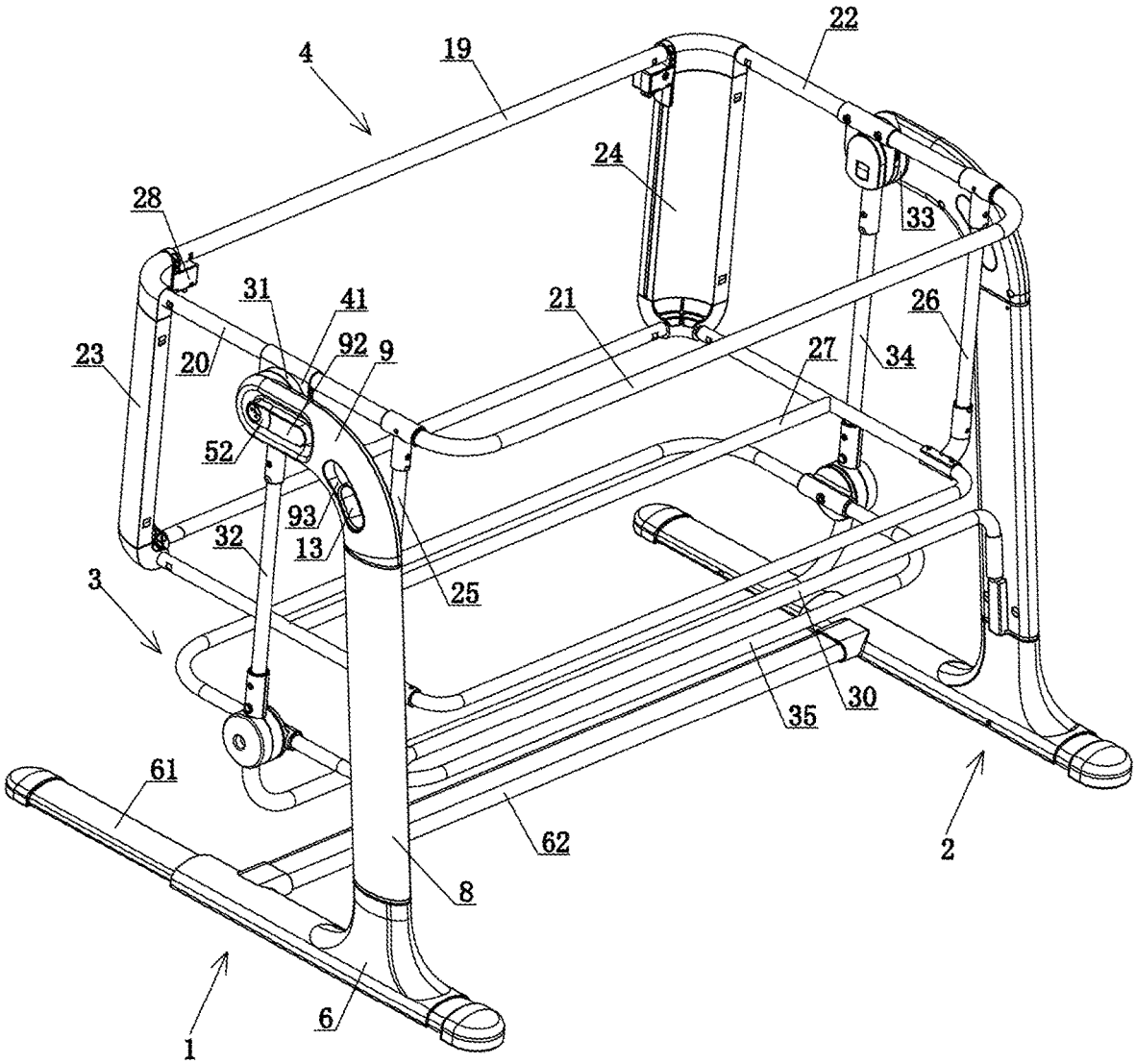
FIG. 1 is a structural schematic diagram of the present invention.
Figure 6:
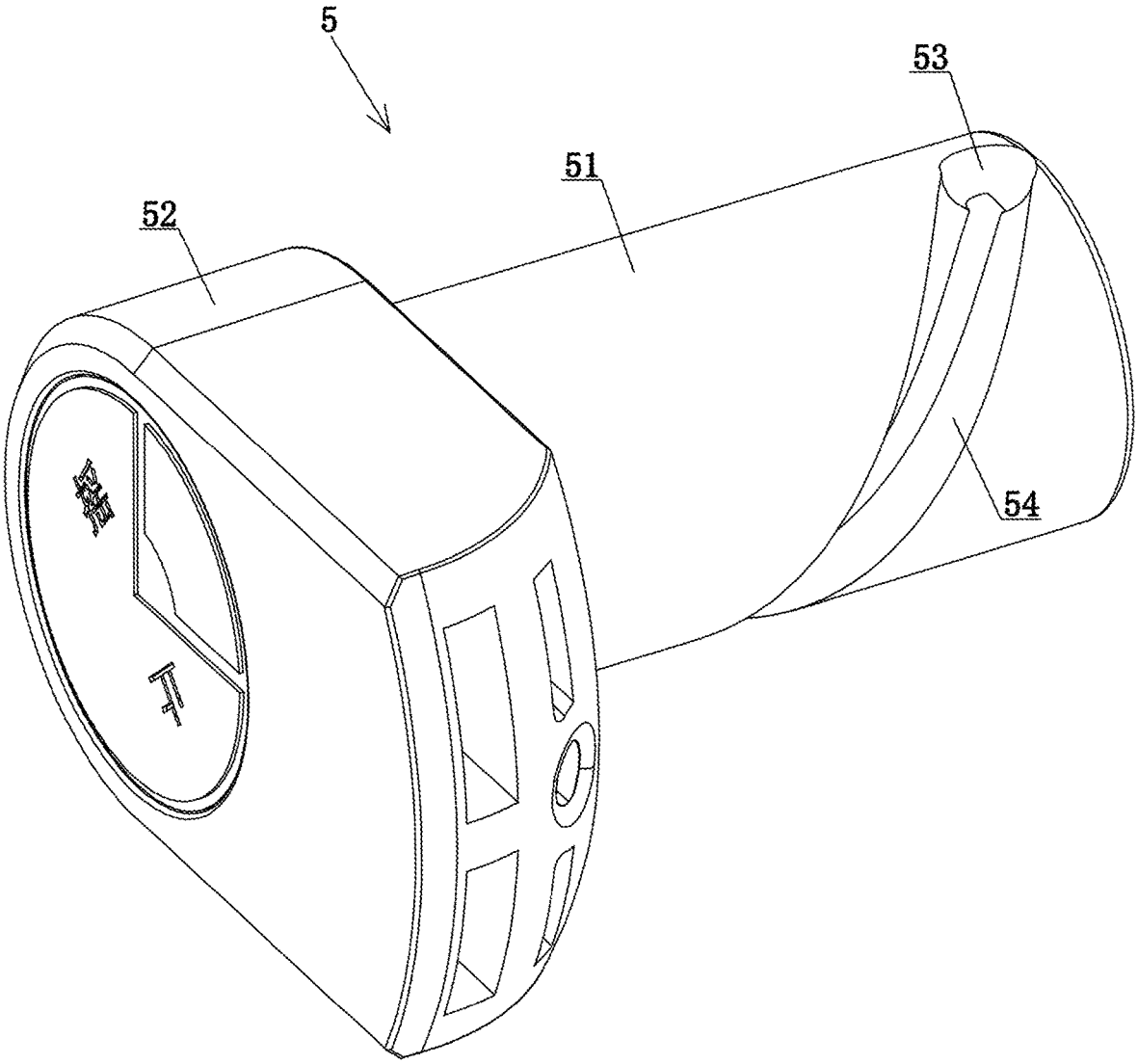
FIG. 6 is a structural schematic diagram of the rotating device of the present invention.
Figure 7:
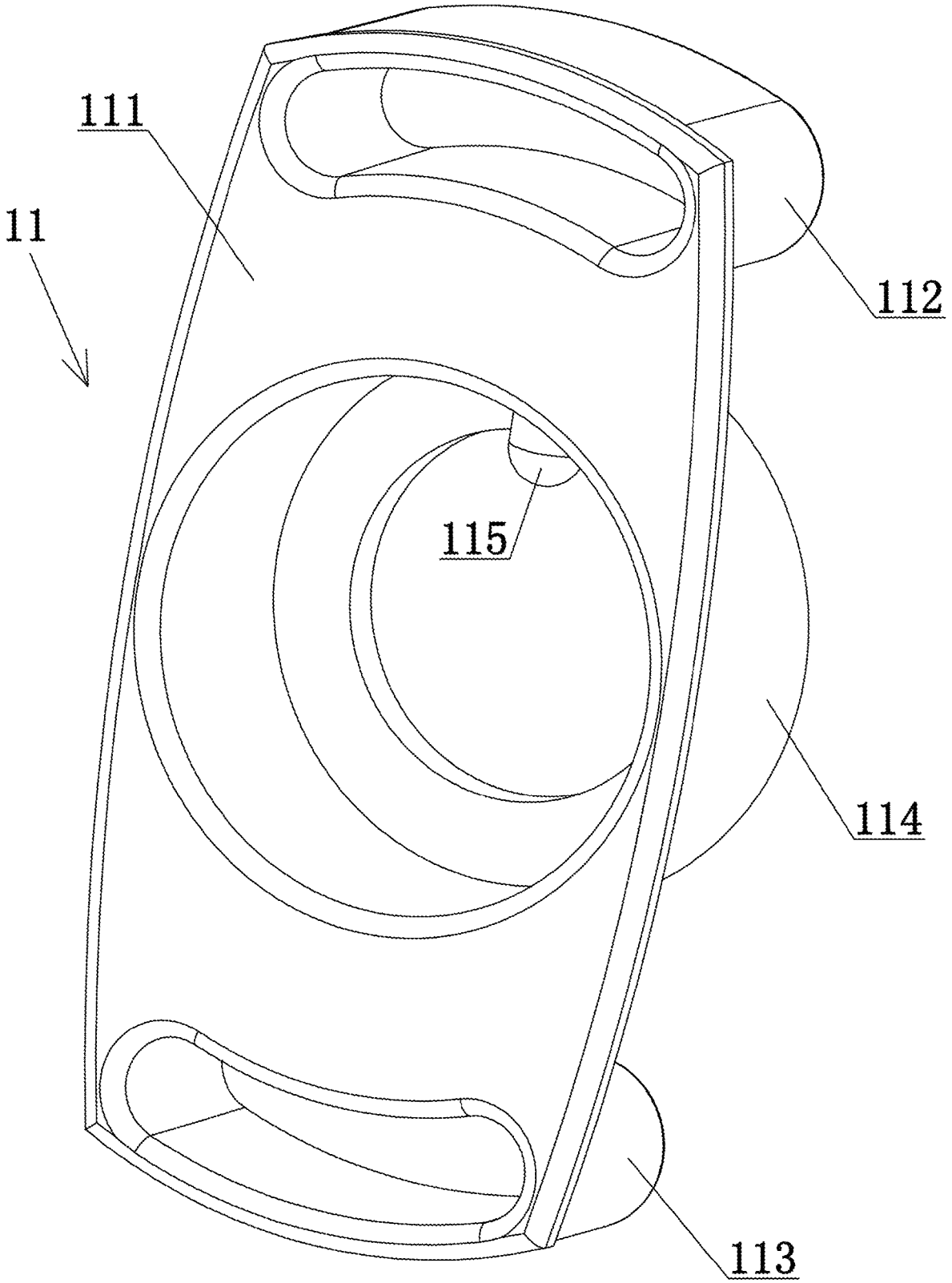
FIG. 7 is a structural schematic diagram of the moving member of the present invention.
Figure 8:
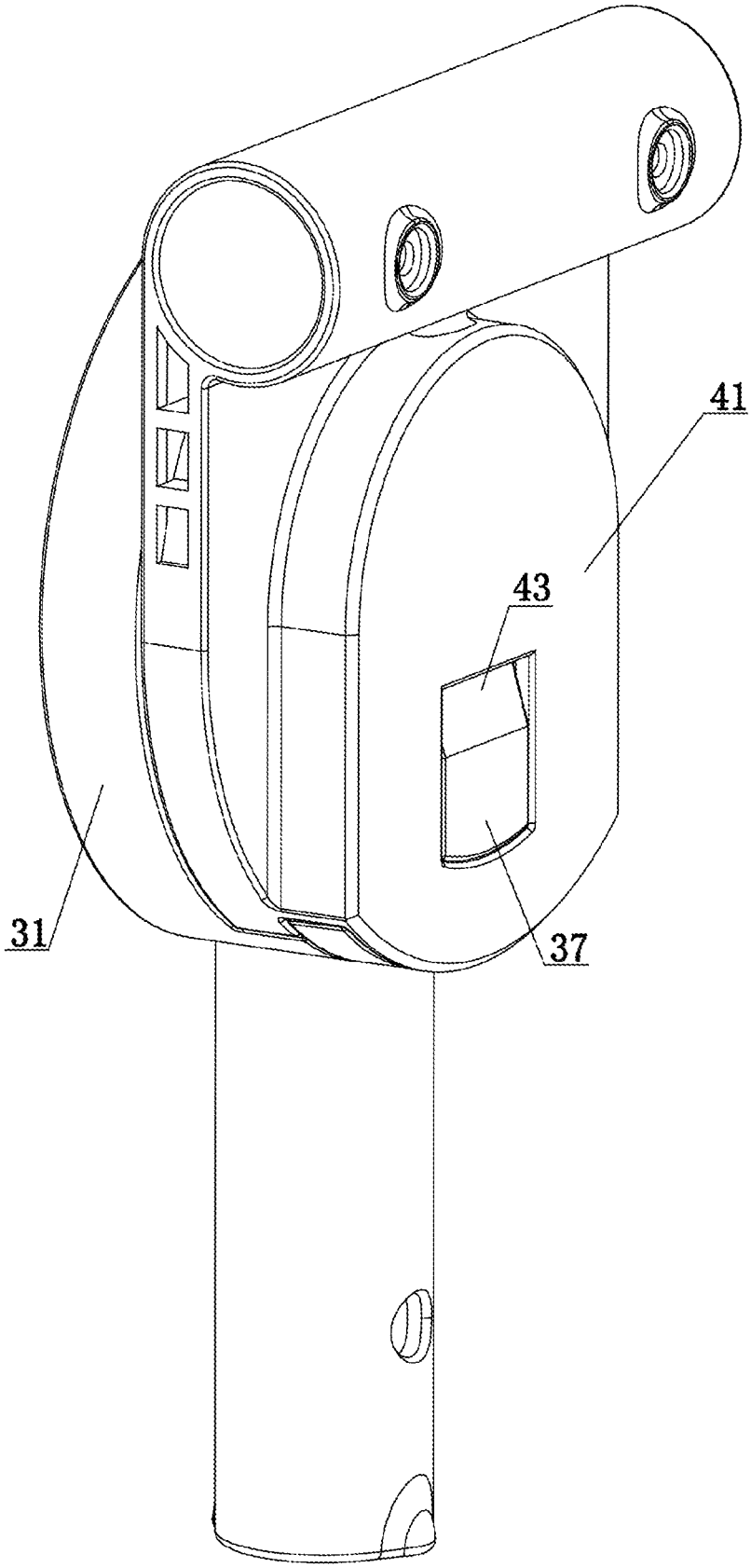
FIG. 8 is a schematic diagram showing the connection structure between the left connecting part and the insertion part of the present invention.
Figure 9:
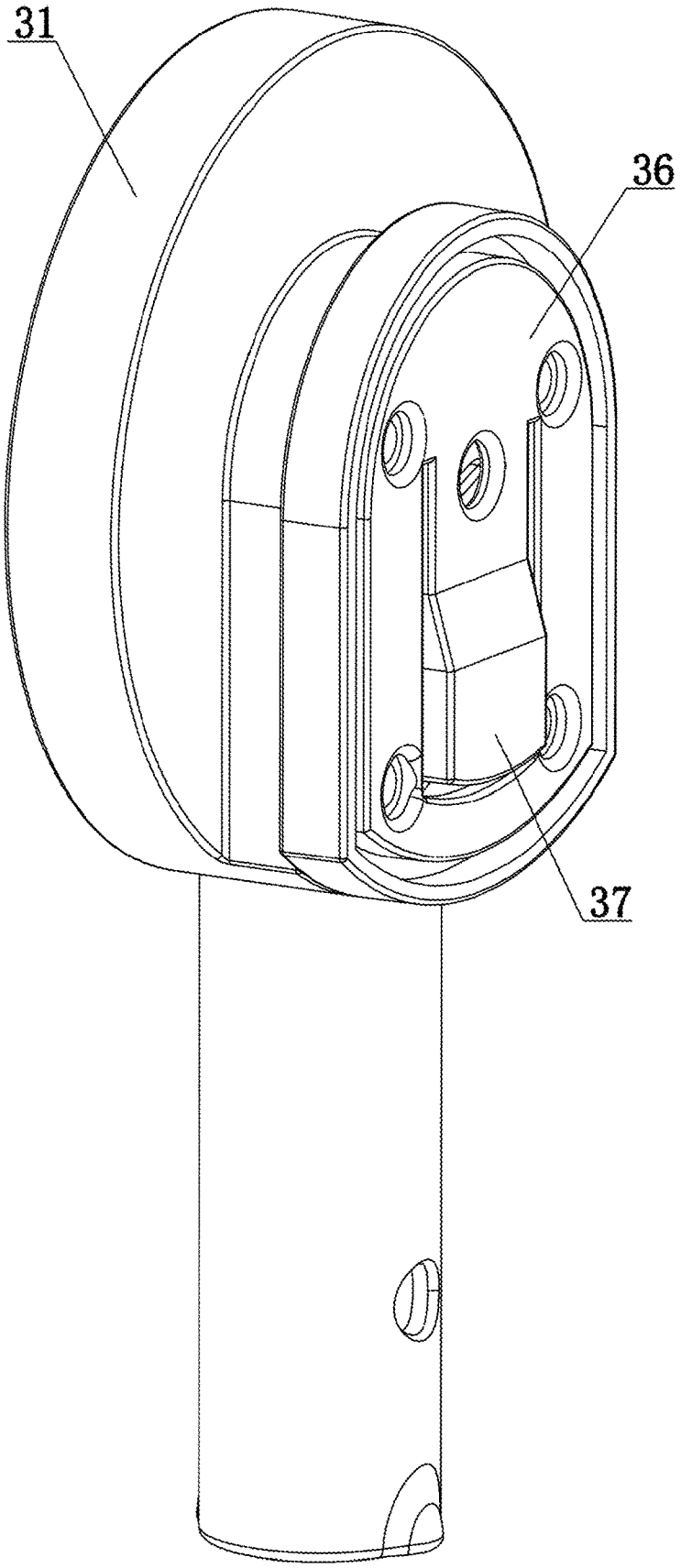
FIG. 9 is a structural schematic diagram of the left connecting part of the present invention.
Figure 10:
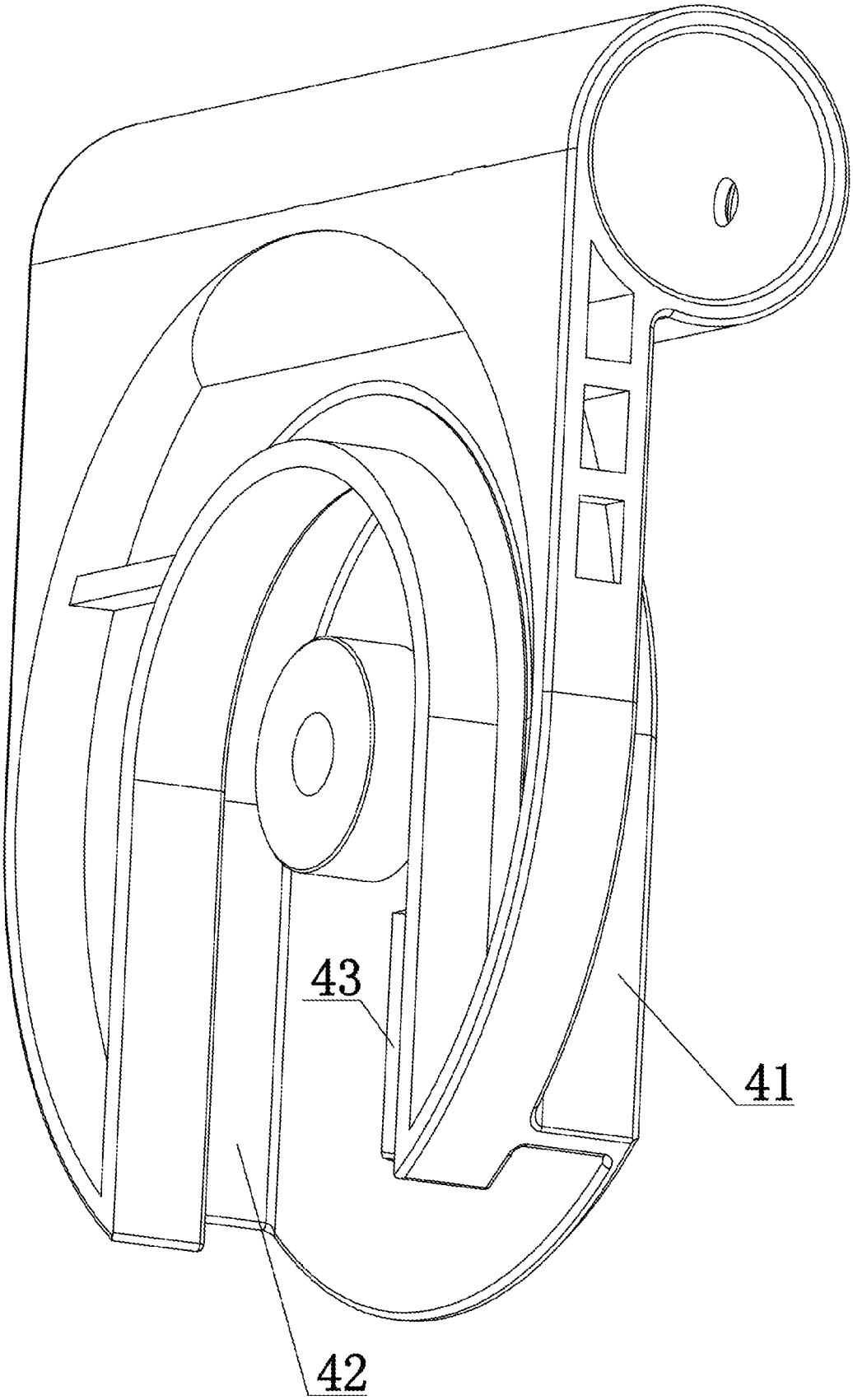
FIG. 10 is a structural schematic diagram of the insertion part of the present invention.

Referring to FIGS. 1 and 6, a multi-functional baby bed includes the left support frame 1, the right support frame 2, the swing frame 3 and the cradle frame 4. The swing frame 3 and the cradle frame 4 are provided between the left support frame 1 and the right support frame 2. The swing frame 3 is pivotably connected to the left support frame 1 and the right support frame 2. The cradle frame 4 and the swing frame 3 are detachably connected. The left support frame 1 and the right support frame 2 have the same structure and are arranged opposite to each other. The top of each of the left support frame 1 and the right support frame 2 is provided with the rotating device 5 configured to control the swing of the swing frame 3. The rotating device 5 can be rotated 90°.

Figure 2:
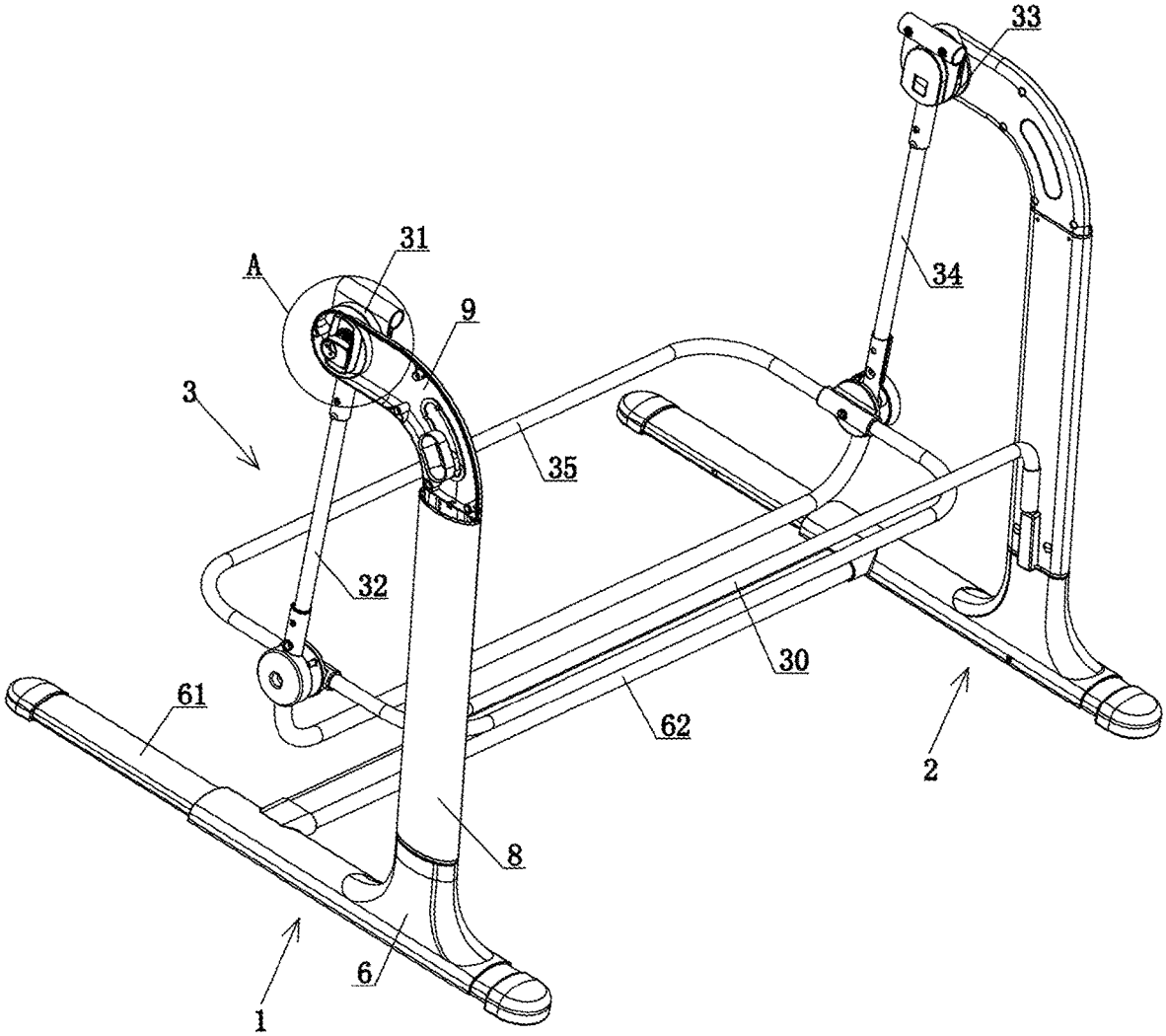
FIG. 2 is a structural schematic diagram of the present invention with the cradle frame removed, wherein some of the curved rods are not shown.
Figure 3:
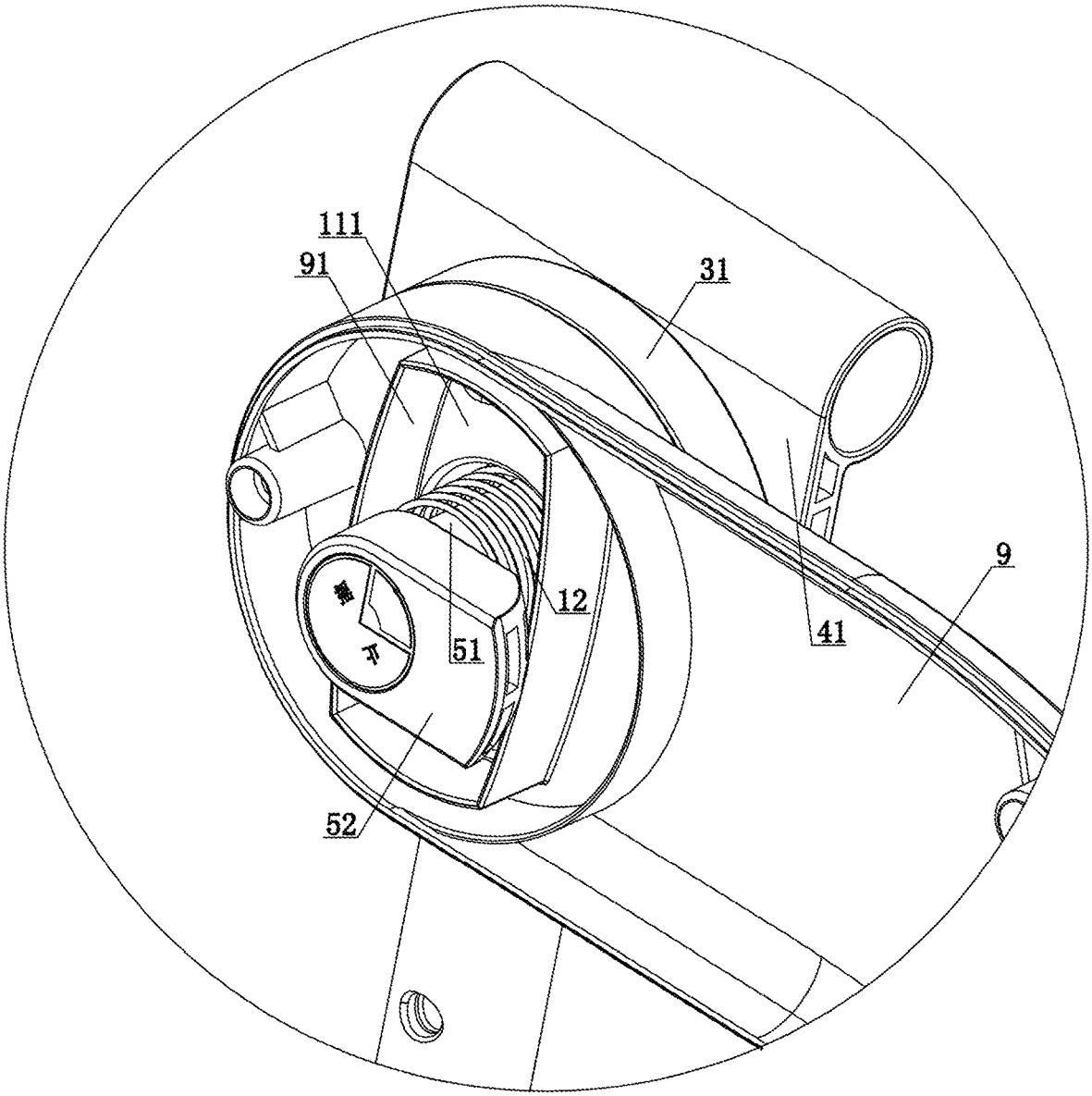
FIG. 3 is a partially enlarged view showing the portion A encircled in FIG. 2.
Figure 4:
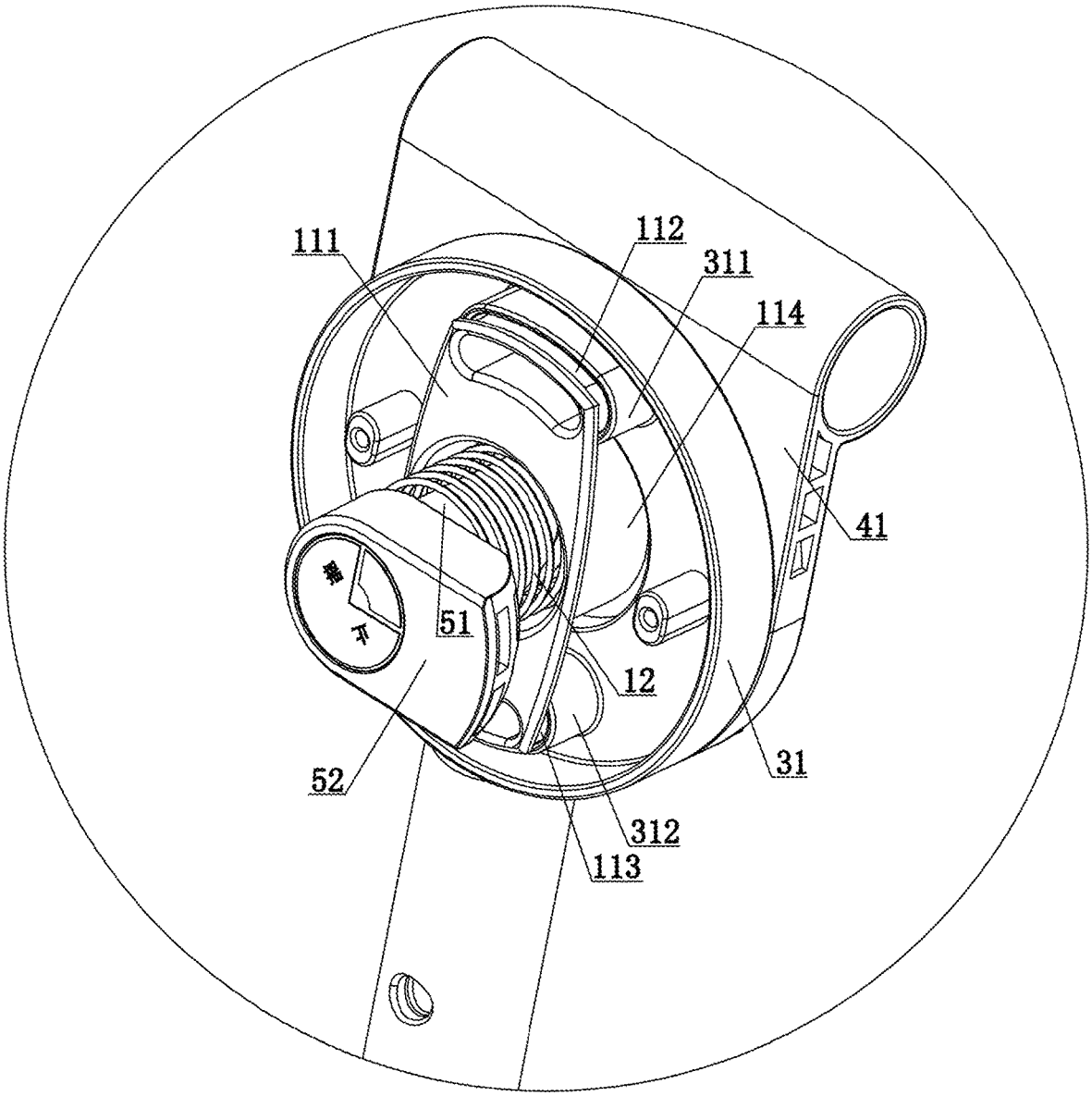
FIG. 4 is a structural schematic diagram of FIG. 3 with the curved rod removed.
Figure 5:
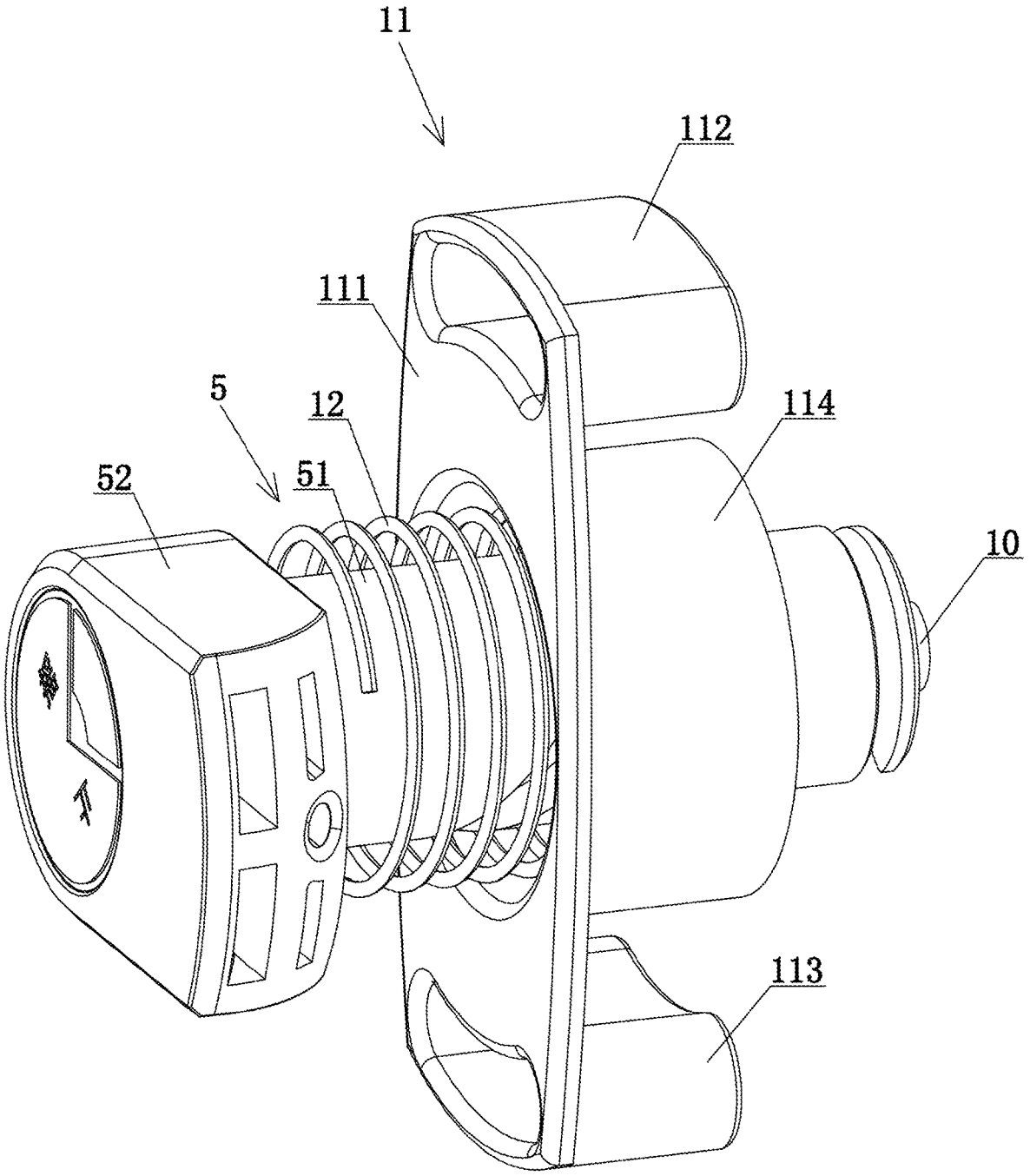
FIG. 5 a schematic diagram showing the connection structure between the rotating device and the moving member of the present invention.
Figure 11:
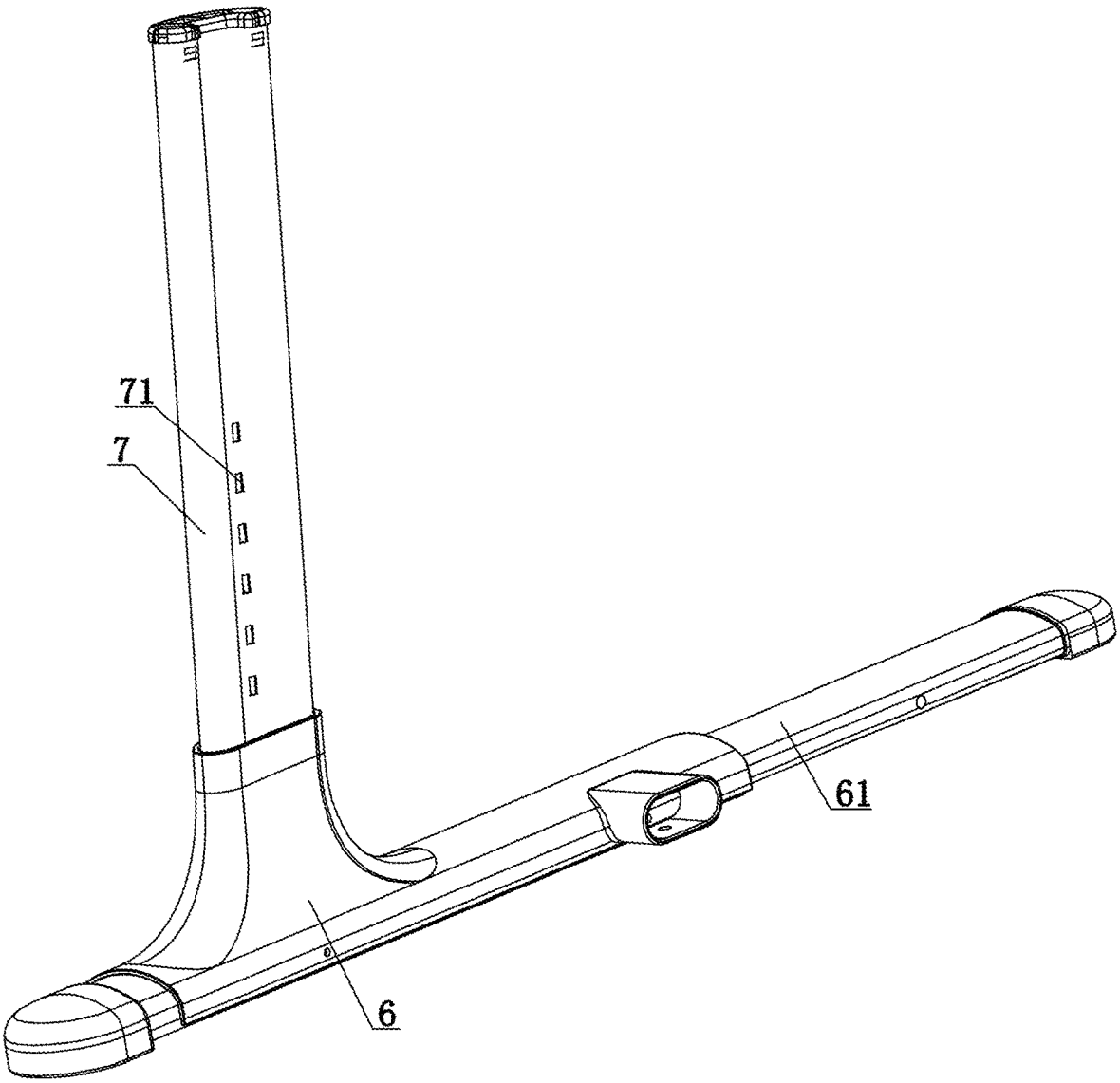
FIG. 11 is a structural schematic diagram showing the connection structure between the support base and the support rod of the present invention.
Figure 12:
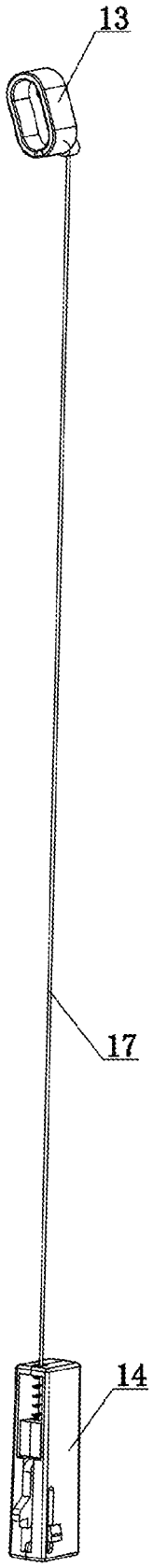
FIG. 12 is a schematic diagram showing the connection structure between the pressing part and the lifting block, and the connection structure between the lifting block and the clamping block of the present invention.
Figure 13:
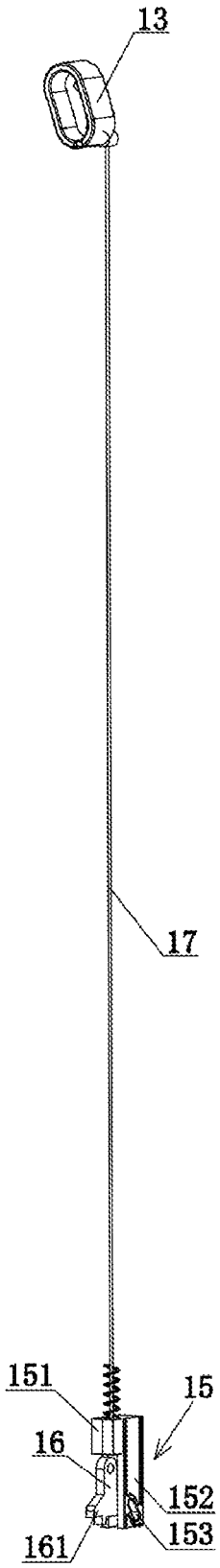
FIG. 13 is a structural schematic diagram of FIG. 11 without the housing.
Figure 14:
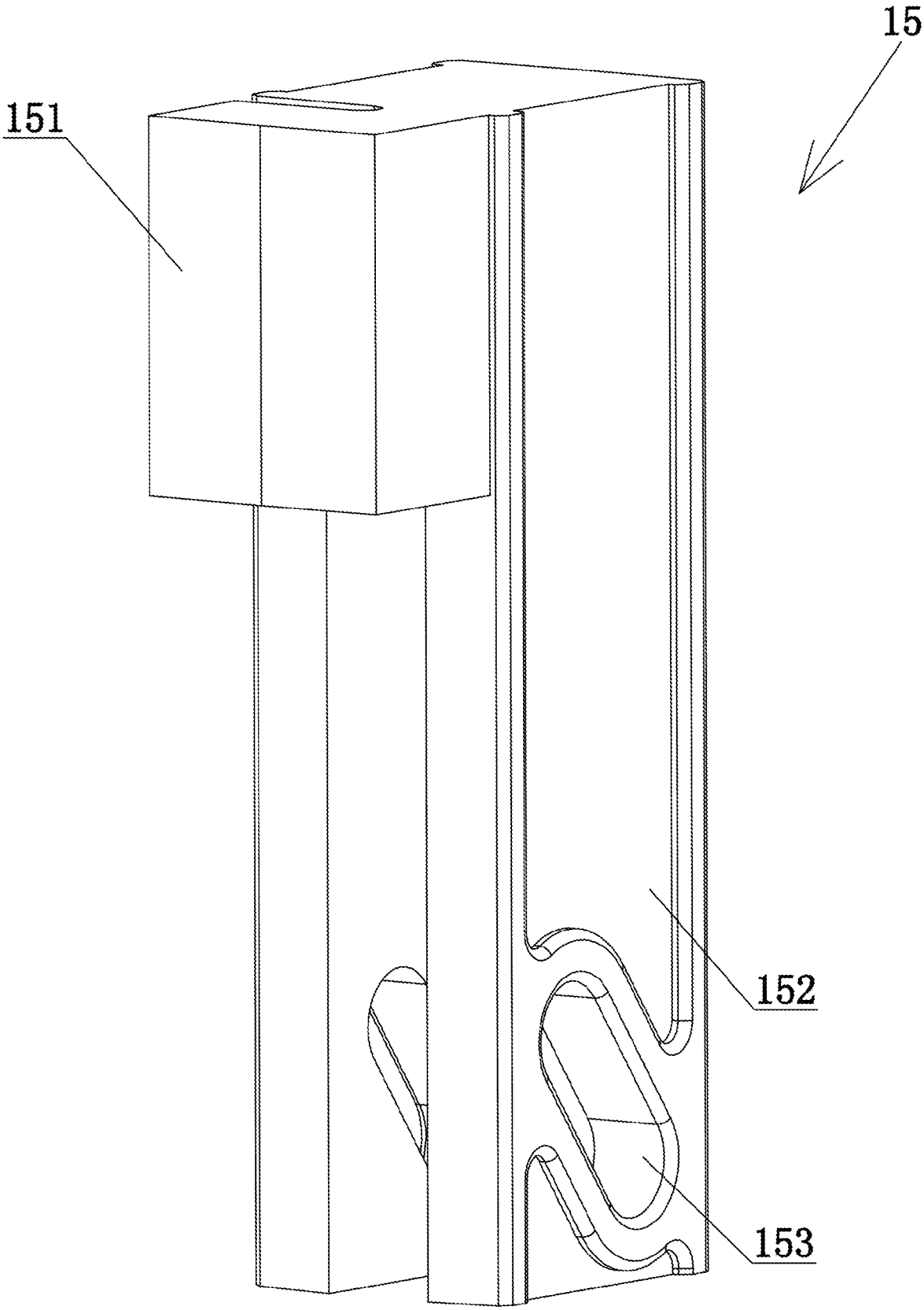
FIG. 14 is a structural schematic diagram of the lifting block of the present invention.
Figure 15:
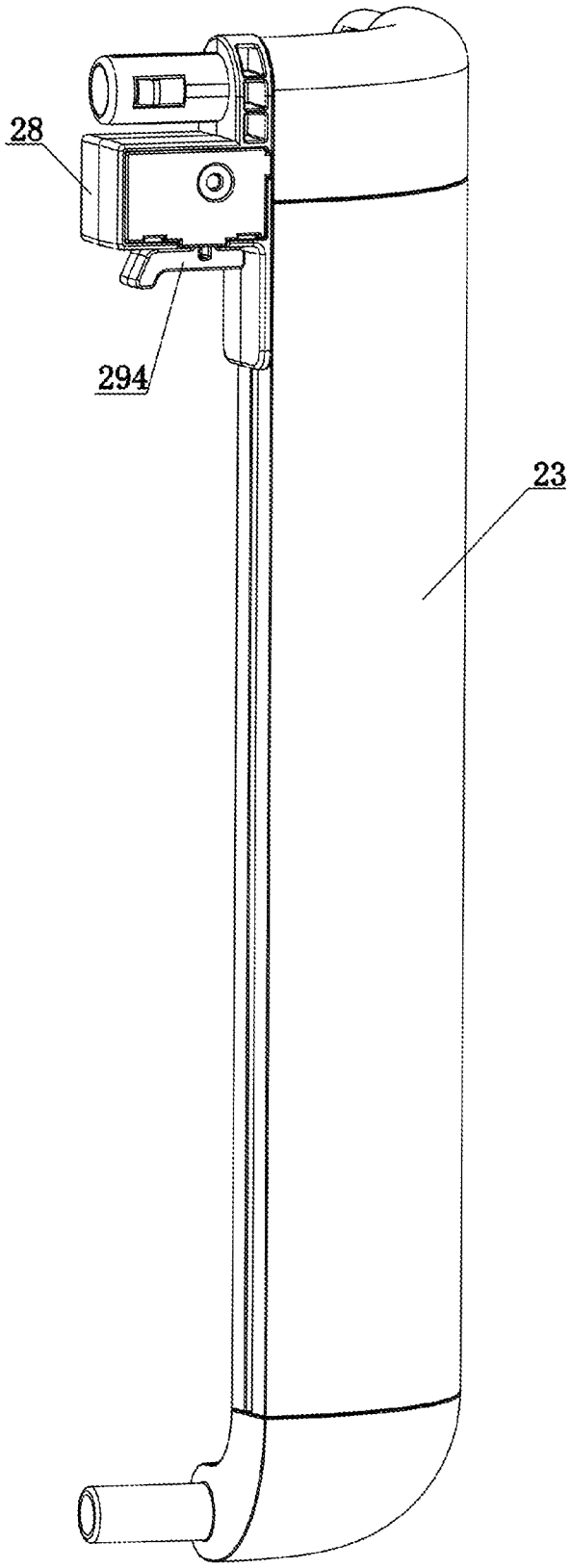
FIG. 15 is a schematic diagram showing the connection structure between the left guide rail and the lifting member of the present invention.
Figure 16:
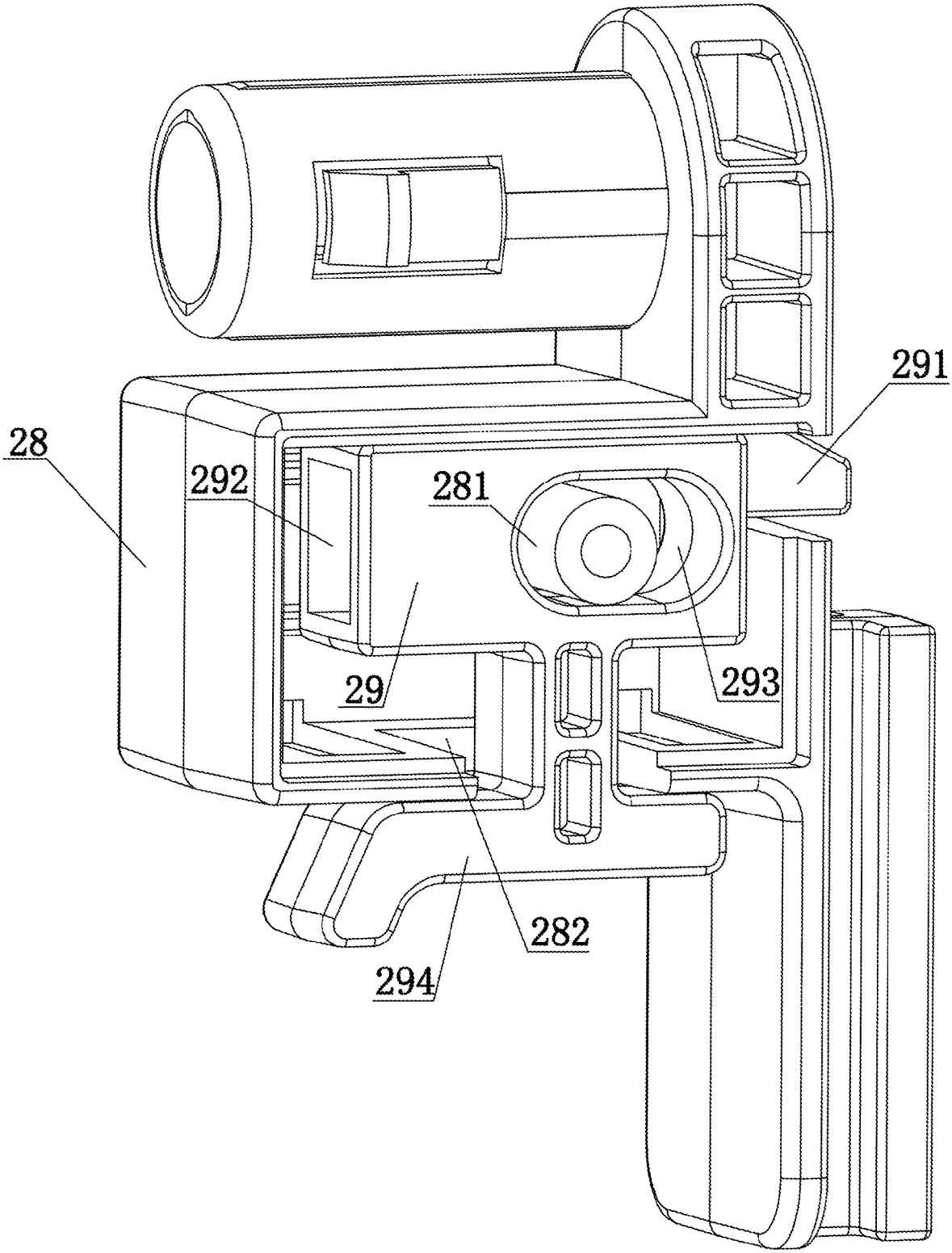
FIG. 16 is a schematic diagram showing the connection structure between the lifting member and the moving block of the present invention, wherein one end surface of the lifting member is not shown.
Figure 17:
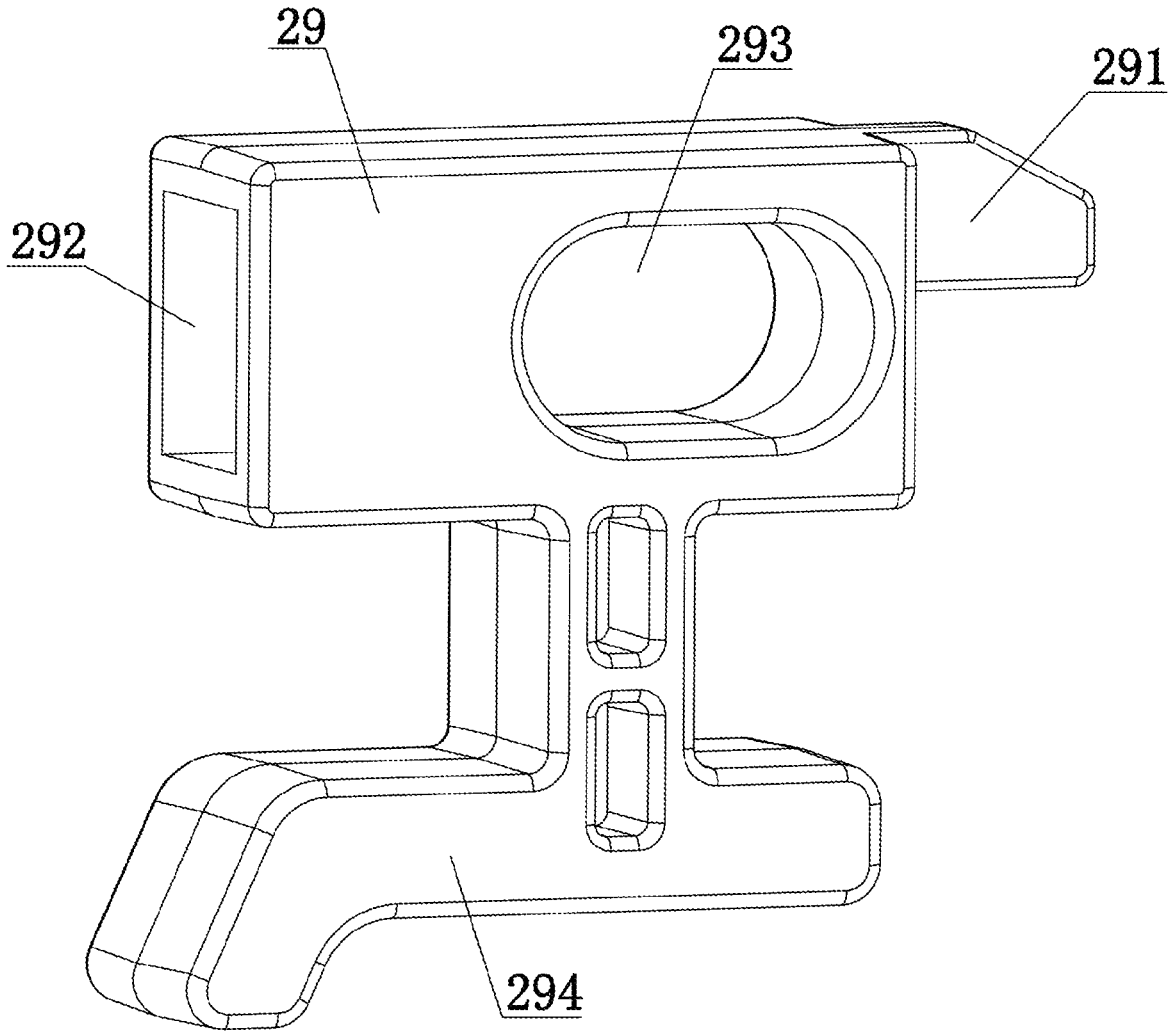
FIG. 17 is a structural schematic diagram of the moving block of the present invention.

Referring to FIGS. 1-2 and 11, each of the left support frame 1 and the right support frame 2 includes the support base 6, the support rod 7, the sleeve rod 8 and the curved rod 9. The bottom of the support rod 7 is connected to the top of the support base 1. The support rod 7 is sleeved inside the sleeve rod 8. The sleeve rod 8 can be lifted and lowered relative to the support rod 7. The bottom of the curved rod 9 is connected to the top of the sleeve rod 8. The swing frame 3 includes the left connecting part 31, the left connecting rod 32, the right connecting part 33, the right connecting rod 34 and the seating frame 35. The top of the left connecting rod 32 is connected to the bottom of the left connecting part 31, and the top of the right connecting rod 34 is connected to the bottom of the right connecting part 33. The seating frame 35 is connected between the bottom of the left connecting rod 32 and the bottom of the right connecting rod 34. The top of the left connecting part 31 is located on the inside of the top of the curved rod 9 of the left support frame 1, and the top of the right connecting part 33 is located on the inside of the top of the curved rod 9 of the right support frame 2.

Referring to FIGS. 1-7, the fixed shaft 10 passes through the inside of the top of the curved rod 9. One end of the fixed shaft 10 passes through the curved rod 9 and is correspondingly connected to the left connecting part 31 or the right connecting part 33. The other end of the fixed shaft 10 extends outside the curved rod 9. The moving cavity 91 is provided in the upper part of the curved rod 9. The moving member 11 is provided inside the moving cavity 91. The moving member 11 includes the baffle 111, the upper plug part 112, the lower plug part 113 and the receiving chamber 114. The upper plug part 112, the receiving chamber 114 and the lower plug part 113 are successively provided from top to bottom on the inner side surface of the baffle 111 and pass through the moving cavity 91. The outer end of the receiving chamber 114 is an open structure. The upper plug chamber 311 and the lower plug chamber 312 are arranged inside each of the left connecting part 31 and the right connecting part 33. The upper plug part 112 and the lower plug part 113 are inserted into the corresponding upper plug chamber 311 and the lower plug chamber 312, respectively. The rotating device 5 includes the rotating cylinder 51 and the rotating part 52. The rotating cylinder 51 and the rotating part 52 are sleeved outside the fixed shaft 10. One end of the rotating cylinder 51 passes through the curved rod 9 and is located in the receiving chamber 114. The other end of the rotating cylinder 51 is connected to the rotating part 52. The rotating part 52 is located on the outer end surface of the curved rod 9. The top surface of one end of the rotating cylinder 51 is provided with the clamping groove 53. The spiral groove 54 connected to the clamping groove 53 is provided on the outer periphery of the rotating cylinder 51. The inner top surface of the receiving chamber 114 is provided with the clamping column 115 matched with the clamping groove 53 and the spiral groove 54. The clamping column 115 is located in the groove 53 when the rotating part 52 is in the horizontal direction. The spring 12 is arranged between the clamping column 115 and the inner side surface of the rotating part 52, and the spring 12 is sleeved outside the rotating cylinder 51.

Referring to FIGS. 1-7, the limiting portion 92 is provided on the outer end surface of the top of the curved rod 9. One end surface of the limiting portion 92 is the first arc surface, and one end surface of the rotating cylinder 51 is the second arc surface matched with the first arc surface. When the rotating part 52 is rotated 90° upwards, the clamping column 115 is disengaged from the clamping groove 53 and is engaged with the spiral groove 54. The moving member 11 moves outwards. The upper plug part 112 and the lower plug part 113 are disengaged from the corresponding upper plug cavity 311 and the lower plug part 312, respectively, so that the left connecting part 31 and the right connecting part 33 can swing relative to the curved rod 8. At this time, the swing frame 3 and the cradle frame 4 can swing under an external force. When the rotating part 52 is rotated 90° downwards, the first arc surface is fitted to the second arc surface, the clamping column 115 is clamped in the clamping groove 53, the moving member 11 moves inwards, and the upper plug part 112 and the lower plug part 113 are inserted into the corresponding upper plug cavity 311 and the lower plug cavity 312, respectively. In this way, the left connecting part 31 and the right connecting part 33 are fixed, so that the swing frame 3 and the cradle frame 4 are also fixed and thus cannot swing.

Referring to FIGS. 1, 8-9, and 10, the inner side surface of each of the left connecting part 31 and the right connecting part 33 is provided with the first inserting part 36. Two insertion parts 41 are arranged on the left side and right side of the cradle frame 4, respectively. The two insertion parts 41 correspond to the first inserting part 36 of the left connecting part 31 and the first inserting part 36 of the right connecting part 33, respectively, and are each provided with the first slot 42. The first inserting part 36 is inserted into the corresponding first slot 42. The inner side surface of the first inserting part 36 is provided with the elastic clamping part 37. The inner side surface of the insertion part 41 is provided with the clamping groove 43 in which the elastic clamping part 37 is clamped. When the elastic clamping part 37 is pressed, the elastic clamping part 37 is separated from the clamping groove 43, and the insertion part 41 is separated from the first inserting part 36, so as to remove the cradle frame 4 from the swing frame 3.

Referring to FIGS. 1 and 11-14, one side surface of the bottom of the curved rod 9 is provided with the arc-shaped groove 93. The arc-shaped groove is provided with the pressing part 13. The housing 14 is fixedly arranged at the bottom of the sleeve rod 8. The lifting block 15 and the clamping block 16 are arranged inside the housing 14. The lifting block 15 is configured to drive the clamping block 16 to rotate. One end of the clamping block 16 is the clamping portion 161. The inner side surface of the support rod 7 is provided with a plurality of notches 71 spaced apart longitudinally, wherein the clamping portion 161 is clamped in the plurality of notches 71. The pull rope 17 is provided between the lifting block 15 and the pressing part 13. The first spring 18 is provided between the top surface of the lifting block 15 and the inner top surface of the housing 14. The first spring 18 is sleeved on the pull rope 17. The lifting block 15 includes the connecting part 151 and two connecting plates 152 located at the bottom of the connecting part 151. The two connecting plates 152 are spaced apart and each provided with the inclined through slot 153. The clamping block 16 has three ends. A first end of the three ends of the block 16 is the clamping portion 161. A second end of the three ends of the block 16 is hinged to the inner side surface of the housing 14. A third end of the three ends of the block 16 is hinged to the through slot of the two connecting plates 152.

Referring to FIGS. 1 and 11-14, when the pressing part 13 is flipped upward, the pressing part 13 drives the lifting block 15 to ascend via the pull rope 17, and the lifting block 15 drives the clamping block 16 to rotate, so that the clamping portion 161 is disengaged from the notch 71. At this time, the sleeve rod 8 can be lifted and lowered. When the pressing part 13 is released, the lifting block 15 descends, the clamping block 16 is rotated, and the clamping portion 161 is clamped into the corresponding notch 71 again.

Referring to FIGS. 1 and 15-17, the cradle frame 4 includes the lifting tube 19, the left tube 20, the rear tube 21, the right tube 22, the left guide rail 23, the right guide rail 24, the left vertical tube 25, the right vertical tube 26 and the support frame 27. The left guide rail 23, the right guide rail 24, the left vertical tube 25, and the right vertical tube 26 are arranged at four corners of the support frame 27. The inner side surface of the left guide rail 23 and the inner side surface of the right guide rail 24 are each provided with the lifting member 28 that can be lifted and lowered along the left guide rail 23 and the right guide rail 24. The lifting tube 19 is provided between the lifting member 28 on the left guide rail 23 and the lifting member 28 on the right guide rail 24. The left tube 20 is connected between the top of the left guide rail 23 and the top of the left vertical tube 25. The rear tube 21 is connected between the top of the left vertical tube 25 and the top of the right vertical tube 26. The right tube 22 is connected between the top of the right vertical tube 26 and the top of the right guide rail 24. The four corners of the support frame 27 are connected to the bottom of the left guide rail 23, the bottom of the right guide rail 24, the bottom of the left vertical tube 25 and the bottom of the right vertical tube 26, respectively. The middle of the left tube 20 and the middle of the right tube 22 are respectively connected to the tops of the two insertion parts 41.

Referring to FIGS. 1 and 15-17, the lifting member 28 is a hollow structure. The moving block 29 is provided inside the lifting member 28. Each of the upper part of the inner side surface of the left guide rail 23 and the upper part of the inner side surface of the right guide rail 24 is provided with a second slot (not shown in the figures). One end of the moving block 29 is provided with the second inserting part 291. The second inserting part 291 extends out of the lifting member 28 and is inserted into the corresponding second slot (not shown in the figures). The other end of the moving block 29 is provided with the spring receiving groove 292. The second spring (not shown in the figures) is arranged between the spring receiving sleeve 292 and the inner side surface of the lifting member 28. The moving member 29 is provided with the strip-shaped limit groove 293. The inner side wall of the lifting member 28 is provided with the limit rod 281 extending into the strip-shaped limit groove 293. The bottom surface of the moving member 29 is provided with the flipping portion 294. The bottom surface of the lifting member 28 is provided with the moving slot 282. The flipping portion 294 extends outside the moving slot 282.

Referring to FIGS. 1 and 15-17, when the flipping portion 294 is flipped inward, the moving member 29 moves inward, so that the second inserting part 291 is separated from the second slot (not shown in the figures), and the lifting tube 19 can be lowered at this time. The lifting tube 19 is pulled upward, so that the second inserting part 291 is inserted into the second slot (not shown in the figures), thus fixing the lifting tube 19.

Referring to FIG. 1, the telescopic inner tube 61 is provided inside one end of the support base 6. The telescopic inner tube 61 is available in the prior art and thus not described in detail herein. The first reinforcing rod 62 is provided between the support base 6 of the left support frame 1 and the support base 6 of the right support frame 2. The second reinforcing rod 30 is provided between the sleeve rod of the left support frame 1 and the sleeve rod of the right support frame 2.

The above description is only the specific embodiments of the present invention, but the present invention is not limited to these embodiments described above. Any non-substantive modifications to the present invention using the concept of these embodiments shall belong to an infringement of the scope of protection of the present invention.

What is claimed is:

1. A multi-functional baby bed, comprising a left support frame, a right support frame, a swing frame and a cradle frame; wherein the swing frame and the cradle frame are provided between the left support frame and the right support frame; the swing frame is pivotably connected to the left support frame and the right support frame; the cradle frame and the swing frame are detachably connected; the left support frame and the right support frame have a same structure and are arranged opposite to each other; a top of each of the left support frame and the right support frame is provided with a rotating device configured to control a movement of the swing frame; and the rotating device is configured to be rotated 90°;

wherein, each of the left support frame and the right support frame comprises a support base, a support rod, a sleeve rod and a curved rod; wherein, a bottom of the support rod is connected to a top of the support base; the support rod is sleeved inside the sleeve rod, and the sleeve rod is lifted and lowered relative to the support rod; a bottom of the curved rod is connected to a top of the sleeve rod.

2. The multi-functional baby bed according to claim 1, wherein, the swing frame comprises a left connecting part, a left connecting rod, a right connecting part, a right connecting rod and a seating frame; wherein, a top of the left connecting rod is connected to the bottom of the left connecting part, and the top of the right connecting rod is connected to a bottom of the right connecting part; the seating frame is connected between the bottom of the left connecting rod and the bottom of the right connecting rod; the top of the left connecting part is located on an inside of a top of the curved rod of the left support frame, and the top of the right connecting part is located on an inside of the top of the curved rod of the right support frame.

3. The multi-functional baby bed according to claim 2, wherein, a fixed shaft passes through the inside of the top of the curved rod; a first end of the fixed shaft passes through the curved rod and is correspondingly connected to the left connecting part or the right connecting part; a second end of the fixed shaft extends outside the curved rod; an upper part of the curved rod is provided with a moving cavity; a moving member is arranged inside the moving cavity;

the moving member comprises a baffle, an upper plug part, a lower plug part and a receiving chamber; wherein, the upper plug part, the receiving chamber and the lower plug part are successively arranged from top to bottom on an inner side surface of the baffle and pass through the moving cavity; an outer end of the receiving chamber is an open structure; an upper plug chamber and a lower plug chamber are provided inside each of the left connecting part and the right connecting part; the upper plug part and the lower plug part are inserted into the corresponding upper plug chamber and lower plug chamber, respectively;

the rotating device comprises a rotating cylinder and a rotating part; wherein, the rotating cylinder and the rotating part are sleeved outside the fixed shaft; a first end of the rotating cylinder passes through the curved rod and is located in the receiving chamber, and a second end of the rotating cylinder is connected to the rotating part; the rotating part is located on the outer end surface of the curved rod; a top surface of the first end of the rotating cylinder is provided with a clamping groove, and a spiral groove connected to the clamping groove is provided on an outer periphery of rotating cylinder; an inner top surface of the receiving chamber is provided a clamping column matched with the clamping groove and the spiral groove; the clamping column is located in the clamping groove when the rotating part is in a horizontal direction; a spring is arranged between the clamping column and an inner side surface of the rotating part, and the spring is sleeved outside the rotating cylinder.

4. The multi-functional baby bed according to claim 3, wherein, an inner side surface of each of the left connecting part and the right connecting part is provided with first inserting parts; two insertion parts are arranged on the left side and right side of the cradle frame, respectively; the two insertion parts correspond to the first inserting part of the left connecting part and the first inserting part of the right connecting part, and the two insertion parts are each provided with a first slot; the first inserting part is inserted into the corresponding first slot; an inner side surface of the first inserting part is provided with an elastic clamping part; an inner side surface of the insertion part is provided with a clamping groove and the elastic clamping part is clamped in the clamping groove.

5. The multi-functional baby bed according to claim 4, wherein, the cradle frame comprises a lifting tube, a left tube, a rear tube, a right tube, a left guide rail, a right guide rail, a left vertical tube, a right vertical tube and a support frame; the left guide rail, the right guide rail, the left vertical tube, and the right vertical tube are arranged at four corners of the support frame; an inner side surface of the left guide rail is provided with a first lifting member, and an inner side surface of the right guide rail is provided with a second lifting member; the lifting tube is provided between the first lifting member on the left guide rail and the second lifting member on the right guide rail; the left tube is connected between a top of the left guide rail and a top of the left vertical tube; the rear tube is connected between the top of the left vertical tube and a top of the right vertical tube; the right tube is connected between a top of the right vertical tube and a top of the right guide rail; the four corners of the support frame are connected to a bottom of the left guide rail, a bottom of the right guide rail, a bottom of the left vertical tube and a bottom of the right vertical tube, respectively; a middle of the left tube and a middle of the right tube are respectively connected to the tops of the two insertion parts.

6. The multi-functional baby bed according to claim 5, wherein, the first lifting member and the second lifting member are a hollow structure; a moving block is provided inside each of the first lifting member and the second lifting member; each of the upper part of the inner side surface of the left guide rail and the upper part of the inner side surface of the right guide rail is provided with a second slot;

a first end of the moving block is provided with a second inserting part; the second inserting part extends outside each the lifting first member and the second lifting member, and the second inserting part is inserted into the corresponding second slot; a second end of the moving block is provided with a spring receiving groove; a second spring is provided between the spring receiving groove and an inner side surface of each of the first lifting member and the second lifting member;

a moving member is provided with a strip-shaped limit groove; an inner side wall of each of the first lifting member and the second lifting member is provided with a limit rod extending into the strip-shaped limit groove; the bottom surface of the moving member is provided with a flipping portion; a bottom surface of each of the first lifting member and the second lifting member is provided with a moving slot; the flipping portion extends outside the moving slot.

7. The multi-functional baby bed according to claim 2, wherein, a side surface at the bottom of the curved rod is provided with an arc-shaped groove, and the arc-shaped groove is provided with a pressing part; a housing is fixedly arranged at a bottom of the sleeve rod; a lifting block and a clamping block are provided inside the housing; the lifting block is configured to drive the clamping block to rotate; one end of the clamping block is a clamping portion;

an inner side surface of the support rod is provided with a plurality of notches spaced apart longitudinally, wherein the clamping portion is clamped in the plurality of notches; a pull rope is provided between the lifting block and the pressing part; a first spring is provided between a top surface of the lifting block and an inner top surface of the housing; and a first spring is sleeved on the pull rope.

8. The multi-functional baby bed according to claim 7, wherein, the lifting block comprises a connecting part and two connecting plates arranged at a bottom of the connecting part; the two connecting plates are spaced apart and each provided with the an inclined through slot; the clamping block has three ends; a first end of the three ends of the clamping block is a clamping portion, a second end of the three ends of the clamping block is hinged to an inner side surface of the housing, and a third end of the three ends of the clamping block is hinged to the inclined through slot of the two connecting plates.

9. The multi-functional baby bed according to claim 2, wherein, a telescopic inner tube is provided inside one end of the support base; a first reinforcing rod is provided between the support base of the left support frame and the support base of the right support frame; a second reinforcing rod is provided between the sleeve rod of the left support frame and the sleeve rod of the right support frame.

* * * * *